United States Patent [19]

Masham

[11] Patent Number: 4,806,971

[45] Date of Patent: Feb. 21, 1989

[54] MAGNET FOR USE IN A MAGNETIC BRUSH DEVELOPMENT APPARATUS

[75] Inventor: Roger D. Masham, Hertfordshire, England

[73] Assignee: Xerox Corporation, Stamford, Conn.

[21] Appl. No.: 146,457

[22] Filed: Jan. 21, 1988

[30] Foreign Application Priority Data

Jan. 30, 1987 [GB] United Kingdom ..... 8702050

[51] Int. Cl.[4] ..... G03G 15/09; G03G 15/08

[52] U.S. Cl. ..... 355/3 DD; 118/657; 118/658

[58] Field of Search ..... 355/3 DD; 118/657, 658, 118/652, 656

[56] References Cited

U.S. PATENT DOCUMENTS

| | | | |
|---|---|---|---|
| 4,044,719 | 8/1977 | Ohmori | 355/3 DD X |
| 4,303,331 | 12/1981 | Thompson | 355/3 DD |
| 4,318,607 | 3/1982 | Bonham et al. | 355/3 DD |
| 4,517,719 | 5/1985 | Okumura et al. | 29/124 |
| 4,597,661 | 7/1986 | Yamashita | 355/3 DD |

OTHER PUBLICATIONS

Article: Eliminate Shape Restrictions with Molded Plastic Magnets; Authors: John Theberge et al.; Machine Design Magazine dated 2/10/77.

Article: Magnalox Injection Molded Magnetics; Published by Xolox Corporation of Fort Wayne, Indiana.

Article: Custom Molded Plastic Magnetics; published by Tengam Engineering Inc. of Otsego, Michigan.

*Primary Examiner*—L. T. Hix

*Assistant Examiner*—D. Rutledge

*Attorney, Agent, or Firm*—H. Fleischer; J. E. Beck; R. Zibelli

[57] ABSTRACT

A cylindrical magnet for a magnetic brush developer unit used in an electrophotographic printing machine is of U-shaped cross section having a cylindrical outer surface, and a cavity through which extends the rotary axis of the sleeve. The material forming the magnet is a moldable plastic containing a comminuted ferrite. The longitudinal, angularly spaced, poles are produced in the material during the molding operation. The magnetic body is bonded to end support members, and it is self-supporting between them.

7 Claims, 1 Drawing Sheet

MAGNET FOR USE IN A MAGNETIC BRUSH DEVELOPMENT APPARATUS

This invention relates generally to an electrophotographic printing machine, and more particularly concerns a magnetic brush developer unit used therein.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a magnetic brush developer unit, a stationary cylindrical magnet, or array of magnets, is mounted within a rotary sleeve of nonmagnetic material such that the magnetic field of the magnet projects beyond the outer surface of the sleeve. A magnetic dry developer material (which may be of one component or of two, i.e. carrier plus toner) is delivered to the surface of the sleeve. The magnetic field then causes the developer material to agglomerate in one or more ridges extending along most of the length of the sleeve. The ridge of developer material can be likened to the head of a brush, of which the sleeve is the handle.

The photoconductive member, or any other medium having a latent electrostatic image of an original document being copied recorded thereon, is passed close to the sleeve so that the brush head 'wipes' the whole of that surface having the latent image. The strength of the attraction between the image and particles of toner is arranged to be greater than that between the toner and the magnetic field. The attraction between adjacent 'non-image bearing' areas and the toner is less than that exerted on the toner by the magnetic field, so that toner becomes deposited preferentially on the image to form the toner powder image thereon.

As the sleeve bearing the developer material is rotated through the stationary multi-polar magnetic field of the brush, particles in the brush are subjected to counter acting and varying forces —frictional, electrostatic and magnetic—which results in the particles being in constant movement. This ensures that fresh toner is always available at the surface of the brush head to ensure uniform development of the image.

The ends of the rod have the rotary sleeve journaled on them, and they enable the magnetic brush to be supported in the magnetic brush developer unit. To this end, it is known to provide a flat on one end of the rod with which a detent engages to determine the orientation of the magnetic fields with respect to the path of the copy sheet, and to keep the magnet stationary as the outer sleeve is rotated.

Various magnets have been devised for magnetic brush developer units used in electrophotographic printing machines. The following disclosures appear to be relevant:

U.S. Pat. No. 4,303,331
Patentee: Thompson
Issued: Dec. 1, 1981
U.S. Pat. No. 4,318,607
Patentee: Bonham et al.
Issued: Mar. 9, 1982
U.S. Pat. No. 4,517,719
Patentee: Okumura et al.
Issued: May 21, 1985
Molded Plastic Magnets
Machine Design
Page 112, Feb. 10, 1977
Author: Theberge et al.
Magnalox Injection Molded Magnetics
Xolox Corporation
Fort Wayne, Ind.
Custom Molded Plastic Magnets
Tengam Engineering, Inc.
Otsego, Mich.

The relevant portions of the foregoing disclosures may be summarized as follows:

U.S. Pat. No. 4,303,331 discloses a magnet used in a magnetic brush developer unit in the form of a rod of mild steel having formed on its surface a layer of magnetic material of roughly C-shaped cross section. The cylindrical face of the magnetic material has a plurality of magnetic poles formed in it, whereas the incompleteness of the magnetic layer both economizes on material and provides a zone of zero magnetic field.

U.S. Pat. No. 4,318,607 describes magnet for use in a magnetic brush developer unit. The magnet includes a cylindrical portion having a shaft molded integrally on one end thereof and extending along the longitudinal axis thereof. A ring shaped bearing mounting is molded integrally with the cylindrical portion on the other end thereof.

U.S. Pat. No. 4,517,719 discloses a developer unit magnet having a plurality of magnets secured in a thermosetting resin layer. One magnet is used to attract the magnetic toner and the other magnets are used to retain the attracted toner. A groove is provided in the retaining layer outside the magnetic force generating part to absorb strain.

Theberge et al. describes a process of injection molding plastic matrix magnets. The magnetization step is done either during molding or after molding depending on the final magnetic properties required.

The Xolox brochure describes injection molded permanent magnets.

The Tengam brochure describes customized injection molded plastic magnets.

In accordance with one aspect of the present invention, there is provided a cylindric magnet for use in a magnetic brush developer unit. The magnet includes magnetic poles extending longitudinally and being spaced apart angularly to produce outwardly extending magnetic fields. A monolithic self supporting body molded from a magnetic material has the poles formed thereon. Support members are secured to opposed ends of the body. The support members are made from a different material than the body. The present invention aims at providing a magnet of cheaper construction, by arranging for the body of magnetic material itself to be self-supporting, with the bearing and other functions of the previous rod ends being taken over by a pair of support members secured to the ends of the body of magnetic material. For lower volume applications, the support members may be integrally molded with the body.

Other aspects of the present invention will become apparent as the following description proceeds and upon reference to the drawings, in which.

Figure 1:
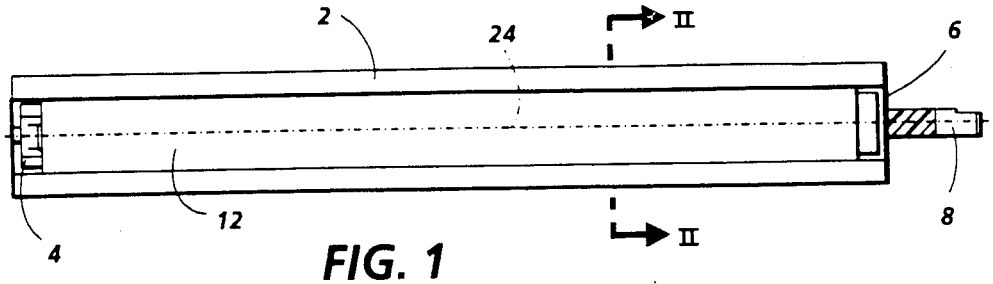
FIG. 1 is a side elevation of a cylindrical magnet of the present invention, looking down into the longitudinal cavity therein.

For a general understanding of the features of the present invention, reference is made to the drawings. In the drawings, like reference numerals have been used throughout to identify identical elements. The magnet shown in FIG. 1 comprises essentially three components: body 2; end support member 4 having in it an axial hole to act as a bearing surface, and end support member 6 which is formed with an axially projecting stub shaft 8.

Body 2 is formed of a moldable plastics material, such as polypropylene, having incorporated within it a powdered magnetic material, such as strontium ferrite. The support members 4 and 6 are formed of a non-magnetic plastics material, such as nylon, which is able to withstand the heat and pressure to which the members are subjected during the molding process by which the body 2 is shaped and the support members become virtually integral parts of the magnet. Alternatively, the support members may be of metal.

Figure 2:
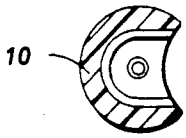
FIG. 2 is a view along the line II—II of FIG. 1.
Figure 3:
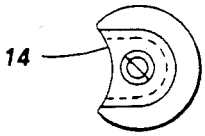
FIG. 3 is an end view of that end of the magnet from which projects a support shaft.

As can be seen from FIGS. 2 and 3, the general cross-sectional shape of body 2 is U-shaped, with the outer surface 10 of the body being a part cylinder, and with the inner surface of the body defining a U-sectioned cavity 12. The two support members 4 and 6 have their outer surfaces provided with a concave recess 14.

Figure 4:
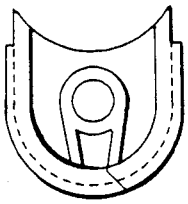
FIG. 4 is an end elevation, but on a larger scale from the previous Figures, of that support member which provides an internal bearing.
Figure 5:
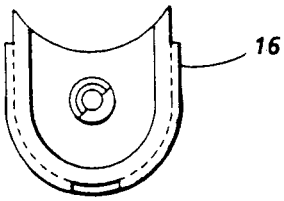
FIG. 5 is a view, similar to FIG. 4, of the other support member, showing the external bearing.
Figure 6:
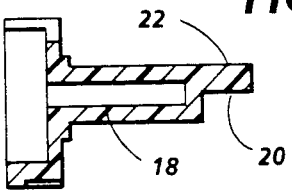
FIG. 6 is a cross-sectional view of the support member shown in FIG. 5, taken along the line VI—VI.

The members 4 and 6, which are shown in greater detail in FIGS. 4, 5 and6, are made in a molding operation separate from that by which the body 2 is formed. As can be seen, the outer surfaces which are intended to become firmly bonded to the body 2 are provided with shallow external ribs 16 to provide a larger surface area of contact and reentrant angles, so that they become mechanically keyed to the body 2 as it is formed.

During the forming process, the two end members are held in place in a suitable mold, into the interior of which is injected a heated and plastic body of the plastics/ferrite mixture which is to function as the magnetic material. The mold is shaped so as to produce the U-sectioned cavity 12 in, and the part-cylindrical outer surface to, body 2.

Although this has not been shown in the drawing, because it does not form part of the subject matter of this invention, that part of the mold which is, or those parts of the mold which are, in contact with the surface 10 are provided with buried magnetizing elements at positions related to the intended position of the magnetic poles in the resultant magnet. These magnetizing magnets may be energized at a suitable stage in the molding process, and with the appropriate strength and polarity as to produce the desired poles, which extend longitudinally of body 2 in parallel with each other and with the longitudinal axis of the body. This produces the poles of which the disposition and polarity are indicated diagrammatically in FIG. 7.

During the molding process, the pressure exerted on the molding plastics is such that it flows into all the spaces in the mold cavity. The surfaces of the mold proper may be treated with a suitable parting material, to assist in the eventual removal of the magnet from the mold, after its component parts have been separated from one another, but the respective surfaces of the support members 4 and 6 are not so treated. This and their shape results in the magnetic material flowing into an intimate and permanent bond with the support members.

When the material in the mold has cooled sufficiently to be stable, the still hot magnet is removed from the mold and repositioned on a cooling fixture on this it is retained by clamps. The clamps and the fixture reproduce the contact surfaces of the mold, and they are held together with such a force that the magnet is kept firmly in the shape it is intended to remain in use, while the material thereof continues to cool and thus acquires its full eventual mechanical strength.

Although the cavity 12 may thereafter be filled wholly or partially with another material, for whatever reason, this would add to the cost of the magnet and would therefore be used to impart only additional features to the magnet which would be worth the extra expense. However, with the cavity containing only air, the inherent strength of the hollow beam presented by body 2 is sufficient to ensure that when the magnet is kept in a horizontal position, by means of suitable external supports engaging the two support members, the stiffness of body 2 is sufficient to prevent its center from sagging by more than a negligible amount, even in the heated environment of a xerographic copier.

It is intended that the molding process would be so accurate that no machining would be necessary after manufacture in order to produce a magnet having specified dimensions. However, it is conceivable that another manufacturer might choose to make the magnetic body 2 oversize and to reduce it to its intended dimensions by a machining or like material removal operation. However, such an operation would add to the cost of the eventual product, and is usually avoided where possible.

Because it is so well known in magnetic brushes, the rotary sleeve of non-magnetic material has been omitted from the drawing. It would normally be designed to have one end resting on a plain cylindrical portion 18 of the stud shaft 8, which would therefore act as a bearing. Part of the sleeve would extend beyond or outwardly of the stub shaft and be engaged by a drive member by which the sleeve could be rotated. That part of the stub shaft 8 which extends beyond the bearing surface 18 is formed with a flat 20, producing a part shaft 22 of hemicylindrical shape. As already discussed, the flat 20 is engaged by a suitable support for the stub shaft 8 which both bears the respective weight of the magnet and of the sleeve, and also contacts the flat so as to define its angular position about the axis of rotation 24 of the sleeve.

Figure 7:
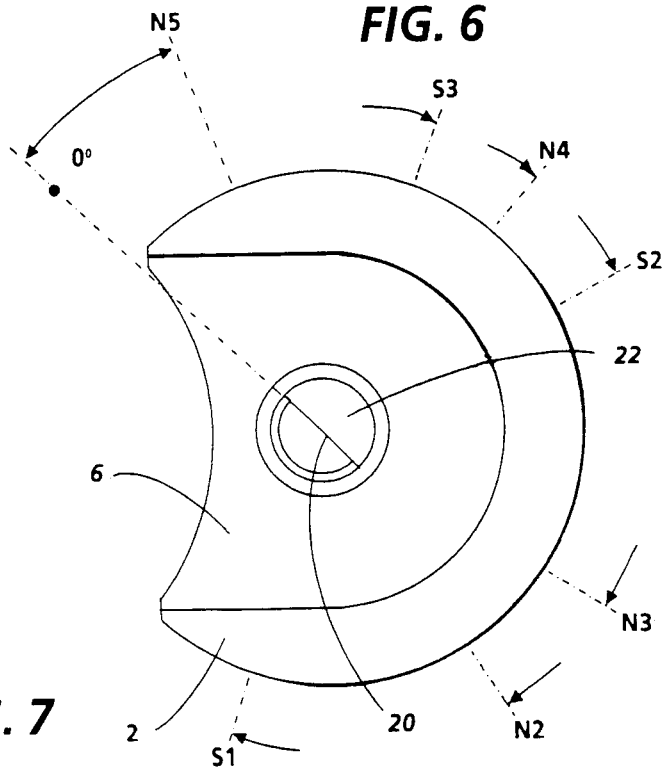
FIG. 7 is an end view, similar to FIG. 3 but on a much larger scale, showing the relative disposition and polarity of the various poles which are impressed on the magnetic material during manufacture.

As shown in FIG. 7, the plane in which the flat 20 lies is used as a reference plane to define the angular disposition of the various magnetic poles which the magnet is given during its manufacturing process. By common convention, the poles are polarized and numbered as shown, not only internally of the applicant company, but generally by magnetic brush manufacturers.

With the magnet of the present invention, it has been found that the indicated spacings and polarities of the different poles result in a 'brush head' of a particularly suitable shape. However, no invention resides in the disposition etc. of the magnetic poles, and so they are not further discussed in this specification.

Accordingly, it would be seen that the present invention provides a cylindrical magnet for a magnetic brush which is easy to manufacture, of low cost, and yet which has the inherent strength necessary for its intended purpose.

In recapitulation, the sheet handling apparatus of the present invention continuously maintains the uppermost sheet of a stack of sheets at a constant level as sheets are added or removed therefrom. The position is selected to account for the human factors requirements associated with loading and unloading reams of sheets by the operator in conjunction with reducing the lag time required for the tray to reach the sheet loading or unloading position.

It is, therefore, evident that there has been provided, in accordance with the present invention, a sheet handling apparatus that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. A magnet for a magnetic brush developer unit, including:

a monolithic self-supporting body of molded magnetic material having a plurality of magnetic poles formed thereon with the magnetic poles extending in a longitudinal direction and being spaced-apart angularly to produce outwardly extending magnetic fields said body having a partially cylindrical outer surface; and a pair of support members, one of said support members being positioned at one end of said body and the other of said support members being positioned at the other end of said body with said pair of support members and said body being made from different materials.

2. A magnet according to claim 1, wherein said body includes a longitudinally extending cavity.

3. A magnet according to claim 2, wherein said cavity includes a substantially U-shaped cross sectional area.

4. A magnet according to claim 3, wherein: said one of said support members includes an internal bearing surface; and said other of said support members includes an external bearing surface.

5. A magnet according to claim 4, wherein said external bearing surface of said other of said support members includes a shaft having substantially D-shaped cross sectional area which provides a flat by which the position of the magnet may be fixed.

6. A magnet according to claim 5, wherein said body is made from a plastic material having a powdered magnetic material therein.

7. A magnet according to claim 6, wherein said support members are made from plastics moldings.

* * * * *